US010369800B2

(12) United States Patent
Rooney et al.

(10) Patent No.: US 10,369,800 B2
(45) Date of Patent: Aug. 6, 2019

(54) PRINTING FLUID CONTAINER

(71) Applicants: Hewlett-Packard Development Company, L.P., Houston, TX (US); Garry Rooney, Ratoath (IE); Frank Woods, Lucan (IE); Bryan Murphy, Lucan (IE)

(72) Inventors: Garry Rooney, Ratoath (IE); Frank Woods, Lucan (IE); Bryan Murphy, Lucan (IE)

( * ) Notice: Subject to any disclaimer, the term of this patent is extended or adjusted under 35 U.S.C. 154(b) by 0 days.

(21) Appl. No.: 15/570,523

(22) PCT Filed: Jul. 31, 2015

(86) PCT No.: PCT/EP2015/001580
§ 371 (c)(1),
(2) Date: Oct. 30, 2017

(87) PCT Pub. No.: WO2017/020915
PCT Pub. Date: Feb. 9, 2017

(65) Prior Publication Data

US 2018/0154645 A1 Jun. 7, 2018

(51) Int. Cl.
*B41J 2/175* (2006.01)

(52) U.S. Cl.
CPC ..... *B41J 2/17536* (2013.01); *B41J 2/17506* (2013.01); *B41J 2/17523* (2013.01); *B41J 2/17553* (2013.01)

(58) Field of Classification Search
CPC ..... B41J 2/17523; B41J 2/17553; B41J 2/17533; B41J 2/17536; B41J 2/17506; B41J 2/1752
See application file for complete search history.

(56) References Cited

U.S. PATENT DOCUMENTS 4,243,150 A * 1/1981 Gunne ..... B65D 47/36 215/247
5,631,681 A 5/1997 Klaus et al.
5,655,687 A 8/1997 Fitten et al.
5,920,333 A * 7/1999 Bates ..... B41J 2/17506 347/85

(Continued)

FOREIGN PATENT DOCUMENTS

CN 1148546 4/1997
CN 101258080 9/2008

(Continued)

OTHER PUBLICATIONS

Brother, "DCP-T300 FAQs and Troubleshooting," articles published on Jun. 12, 2015, 9 pages, available at support.brother.com/g/b/faqend.aspx?c=cn&lang=zh&prod=dcpt300_all&faqid=faq00000230_019, (English translation included).

(Continued)

*Primary Examiner* — Scott A Richmond
(74) *Attorney, Agent, or Firm* — HP Inc. Patent Department

(57) ABSTRACT

A printing fluid container for a printing fluid source for a printer system, wherein the printing fluid container comprises a sealing material layer being arranged in a closure device printing fluid outlet opening, the sealing material layer having a fluid outlet condition, in which the sealing material layer is pierced by engagement of a fluidic interconnect device of the printing fluid source and the closure device printing fluid outlet opening, as well as a printing fluid source, a printer system, a printer system arrangement and a method of filling a printing fluid source.

6 Claims, 5 Drawing Sheets

(56) References Cited

U.S. PATENT DOCUMENTS

| | | | | |
|---|---|---|---|---|
| 6,079,823 | A * | 6/2000 | Droege | B41J 2/17509 347/85 |
| 7,073,546 | B2 | 7/2006 | Woodruff | |
| 8,002,130 | B2 * | 8/2011 | Thilly | B65D 51/002 215/249 |
| 2001/0012038 | A1 | 8/2001 | Gasvoda | |
| 2003/0107629 | A1 | 6/2003 | Kobayashi | |
| 2005/0151809 | A1 | 7/2005 | Corner et al. | |
| 2006/0017790 | A1 | 1/2006 | Jin | |
| 2006/0243756 | A1 | 11/2006 | Kawakita | |
| 2012/0042986 | A1 | 2/2012 | Guhse et al. | |
| 2016/0167850 | A1 * | 6/2016 | Mclaren | B65D 49/12 215/253 |

FOREIGN PATENT DOCUMENTS

| | | | |
|---|---|---|---|
| EP | 0 792 748 | A2 | 9/1997 |
| EP | 1 584 476 | A1 | 10/2005 |
| JP | H08174859 | | 7/1996 |
| JP | 2000-43288 | | 2/2000 |
| JP | 2001510752 | | 8/2001 |
| JP | 2013176968 | | 9/2013 |
| JP | 2013202848 | | 10/2013 |
| JP | 2013248844 | | 12/2013 |
| KR | 1020080016866 | | 2/2008 |
| WO | WO 99/04979 | | 2/1999 |
| WO | WO-2006122757 | A1 | 11/2006 |
| WO | WO 2015/008085 | | 1/2015 |
| WO | WO 2015008085 | A2 * | 6/2016 |

OTHER PUBLICATIONS

White PTFE/red Silicone septa, (Web Page), < http://zjwhxj.en.alibaba.com/product/229539773-220135360/white_PTFE_red_Silicone_septa.html >, 2 pages.

* cited by examiner

PRINTING FLUID CONTAINER

CROSS-REFERENCE TO RELATED APPLICATION

Pursuant to 35 U.S.C. § 371, this application is a United States National Stage Application of European Patent Application No. PCT/EP15/01580, filed on Jul. 31, 2015, the contents of which are incorporated by reference as if set forth in their entirety herein.

FIELD OF THE DISCLOSURE

The description refers to a printing fluid container for a printing fluid source for a printer system. The description further refers to a printing fluid source, a printer system, a printer system arrangement and a method of filling a printing fluid source.

BRIEF DESCRIPTION OF THE DRAWINGS

The present disclosure refers to the accompanying drawings, in which corresponding reference numerals indicate corresponding parts and in which.

DETAILED DESCRIPTION

Figure 1:
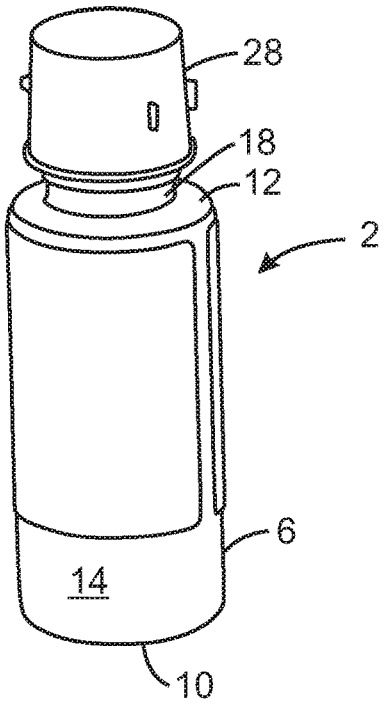
FIG. 1 is an illustration of a printing fluid container with a closure device.
Figure 2:
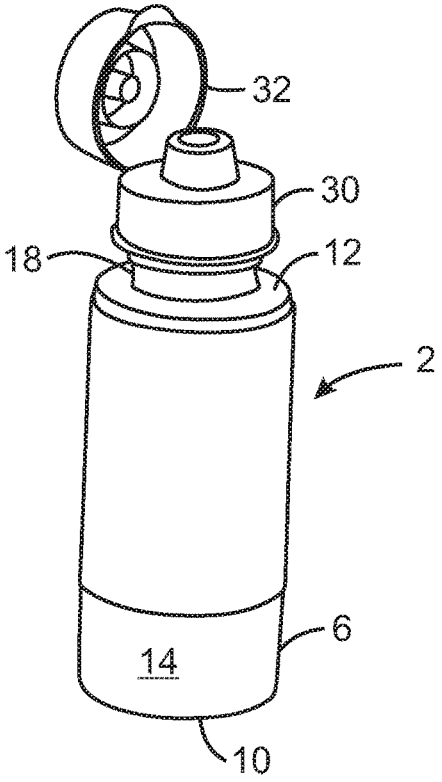
FIG. 2 is an illustration of the printing fluid container of FIG. 1 with the closure device opened.

Various aspect will be described below by referring to the drawings. Features with similar properties or functions, which are shown in multiple figures, are referred to by the same reference numerals and will be explained upon their first mention. However, before proceeding further with a detailed description of the figures, further aspects are discussed According to an aspect, there is provided a printing fluid container for a printing fluid source for a printer system, the printing fluid container comprising a neck having an outer opening; a closure device comprising a closure device main body connected to the neck, wherein the closure device main body comprises a closure device printing fluid outlet opening and a closure device printing fluid outlet passage extending from the outer opening of the neck through the closure device main body to the closure device printing fluid outlet opening; and a sealing material layer being arranged in the closure device printing fluid outlet opening, the sealing material layer having an initial condition, in which the closure device printing fluid outlet opening is sealed, a fluid outlet condition, in which the sealing material layer is pierced by engagement of a fluidic interconnect device of the printing fluid source, which fluidic interconnect device provides a printing fluid inlet passage towards an inner space of the printing fluid source, and the closure device printing fluid outlet opening establishing a fluid path through the closure device printing fluid outlet opening, and re-sealing condition, in which the sealing material layer re-seals the closure device printing fluid outlet opening upon removal of the fluidic interconnect device.

The fluidic interconnect device of the printing fluid source may provide a printing fluid inlet passage towards an inner space of the printing fluid source for filling printing fluid into the inner space of the printing fluid source.

The printing container may comprise a hollow main body defining a container space for printing fluid.

The printing container may comprise a neck printing fluid outlet passage extending from the container space through the neck to the outer opening of the neck.

The closure device may comprise a closure device lid connected to the closure device main body.

The printing fluid container may comprise a neck seal sealing the outer opening of the neck.

The neck seal sealing the outer opening of the neck may be a removable neck seal.

The closure device main body can be removably connected to the neck.

The neck seal may be accessibly upon removal of the closure device.

The closure device lid may comprise a lid member for closing the closure device printing fluid outlet opening.

The closure device lid may have a first position, in which the lid member closes the closure device printing fluid outlet opening, and may have a second position, in which the lid member opens the closure device printing fluid outlet opening.

The closure device lid may be pivotably connected with the closure device main body, wherein the closure device lid, in its first position, is pivoted onto the closure device main body, and the closure device lid, in its second position, is pivoted away from the closure device main body.

The closure device main body may comprise an outer opining at an outer surface of the closure device main body and a closure device printing fluid outlet passageway extending between the closure device printing fluid outlet opening and the outer opening of the closure device.

The closure device printing fluid outlet opening may be located within the closure device main body.

The lid member, in the first position of the closure device lid, may be inserted into the closure device printing fluid outlet passageway, and the lid member, in the second position of the closure device lid, may be removed from the closure device printing fluid outlet passageway.

The sealing material layer may comprise silicone.

The sealing material layer may comprises at least one cut in into its surface.

According to a further aspect, there is provided a printing fluid source for a printer system for use with a printing fluid container, wherein the printing fluid source comprises at least one printing fluid source unit, each of which including an inner space for printing fluid; a fluidic interconnect device having an outer inlet opening and including a printing fluid inlet passage extending from the outer inlet opening of the fluidic interconnect device to the inner space of the printing fluid source; wherein the fluidic interconnect device comprises a piercing portion extending from an outer surface of the printing fluid source, the piercing portion for piercing a sealing material layer of the printing fluid container upon engagement of the fluidic interconnect device and a closure device printing fluid outlet opening of the printing fluid container. The printing fluid source may be a printing fluid source for a continuous ink supply system for a printer system.

According to a further aspect, there is provided a printer system, comprising at least one printing fluid source.

According to a further aspect, there is provided a printer system arrangement comprising a printing fluid container and at least one printing fluid source.

According to a further aspect, there is provided a method of filling a printing fluid source, which comprises a fluidic interconnect device providing a printing fluid inlet passage towards an inner space of the printing fluid source for filling printing fluid into the inner space of the printing fluid source, of a printer system with printing fluid from a printing fluid container, comprising engaging the fluidic interconnect device and the closure device printing fluid outlet opening to pierce the sealing material layer and establishing a fluid path through the closure device printing fluid outlet opening to the printing fluid inlet passage of the fluidic interconnect device; dispensing printing fluid from the printing fluid container to the inner space of the printing fluid source; and removing the printing fluid container from the fluidic interconnect device to re-seal the closure device printing fluid outlet opening by means of the sealing material layer.

The method may include removing the neck seal before engaging the fluidic interconnect device and the closure device printing fluid outlet opening, wherein the neck seal sealing the outer opening of the neck is a removable neck seal.

The method may include removing the closure device main body from the neck before removing the neck seal, wherein the closure device main body is removably connected to the neck.

The method may include engaging the fluidic interconnect device and the closure device printing fluid outlet opening comprises turning the printing fluid container up-side-down from a first position to a second position, and removing the printing fluid container from the fluidic interconnect comprises turning the printing fluid container back into its first position.

The drawings illustrate a printing fluid container 2 for a printing fluid source 4 for a printer system. The illustrated printing fluid source 4 can be used, for example, for so-called continuous ink supply system CISS (also referred to as continuous ink system CIS) of a printer.

The printing fluid container 2 comprises a hollow main body 6 defining a container space 8 for printing fluid. The main body 6 has a closed bottom 10, a top 12 and a wall 14 extending between the bottom 10 and the top 12. The top 12 of the main body 6 has a main body opening 16 through which printing fluid can be introduced into the container space (e.g. during manufacturing of containers filled with printing ink) and removed/dispensed therefrom (for filling/refilling of a printing fluid source of a printer system).

A neck 18 extends from the top 12 of the main body 6. The neck 18 had a neck wall 20 defining a neck printing fluid outlet passage 22 extending from the container space 8 and, particularly, from the main body opening 16 through the neck 18 to an outer opening 24 of the neck 18.

The outer opening 24 of the neck 18 is covered by a seal 26. The seal 26 can be used to seal the container space 8 after being filled with printing fluid during fabrication and to prevent that printing fluid in the printing fluid container 2 is contaminated and/or lost during shipping, storage and the like before being used to fill/refill a printing fluid source.

A closure device 28 is arranged on the neck 18. The closure device 28 comprises a closure device main body 30 and a closure device lid 32.

Figure 3:
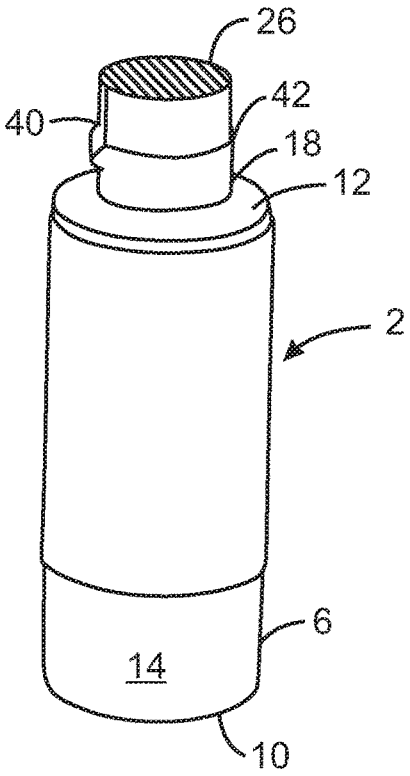
FIG. 3 is an illustration of is the printing fluid container of FIG. 1 with the closure device removed.
Figure 7:
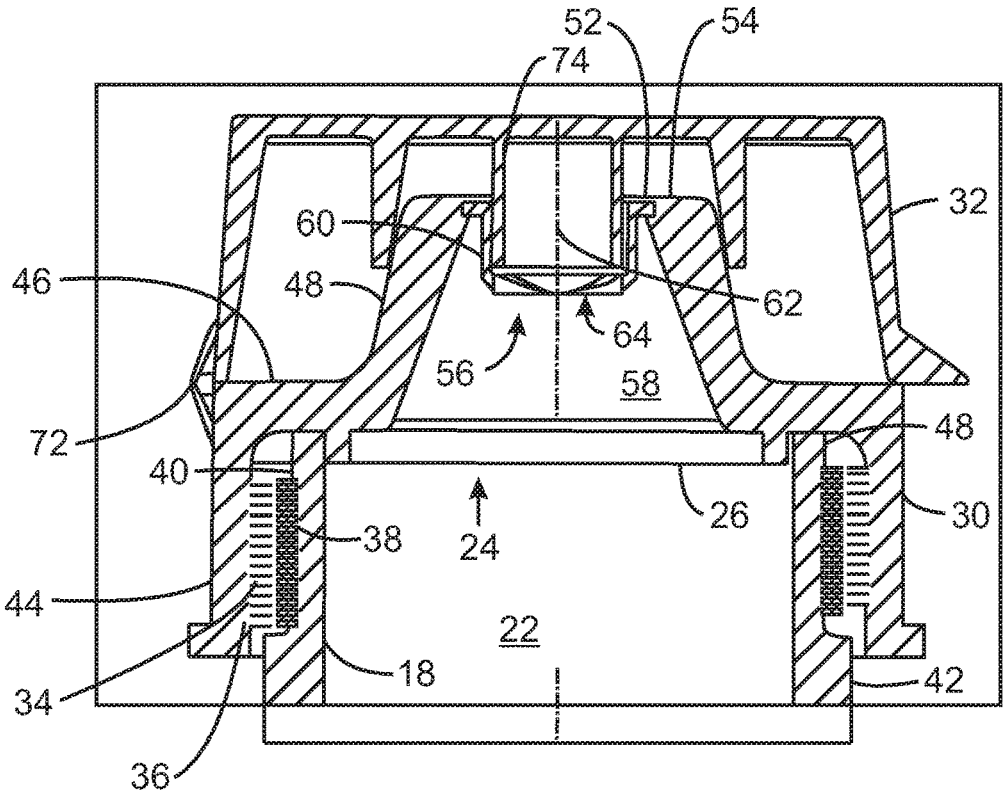
FIG. 7 is a cross-sectional illustration of the closure device and the neck of the printing fluid container of FIG. 6 with a thread connection.
Figure 8:
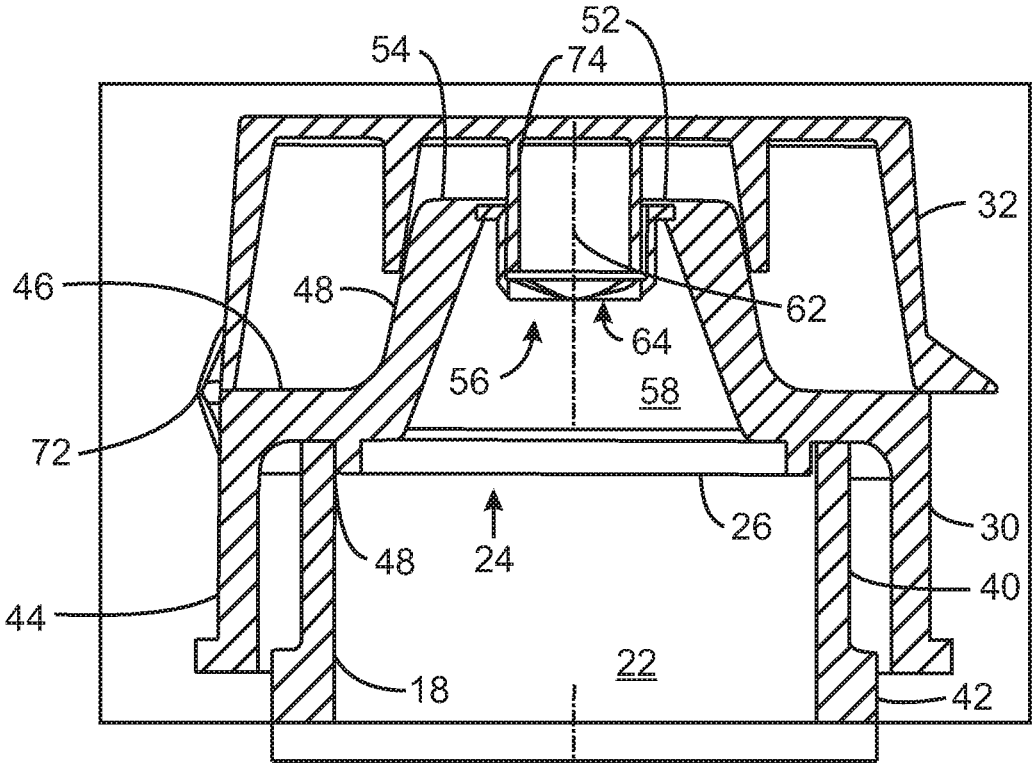
FIG. 8 is a cross-sectional illustration of the closure device and the neck of the printing fluid container of FIG. 6 with a form fit and/or friction fit connection.

The closure device 28 can be connected to the neck 18, particularly in a manner so that the seal 26 can be removed. To this end, the closure device 28 can be releasably connected to the neck 18 by means of a thread connection including e.g. internal threads 34 on an inner surface 36 of the closure device main body 28 and external threads 38 on an outer surface 40 of the neck 18 (see FIG. 7). As alternative, a connection of the closure device 26 and the neck 18 can be achieved by means of a form fit and/or friction fit connection, where the internal surface 36 of the closure device main body 28 and a projecting part 42 (e.g. in form of a ring) of the neck 18 can engage (see FIGS. 3 and 8).

For removing the seal 26, the closure device 28 can be removed from the neck 18 to enable access to seal 26 and its removal. Arranging of the closure device 28 on the neck 18 again re-closes the outer opening 24 of the neck 18 and, hence, the main body opening 16 and the printing fluid container 2.

The closure device main body 30 has a first portion 44, which surrounds the neck 18 when the closure device 28 is arranged on the neck 18. The closure device main body 30 has an intermediate portion 46, which can abut against an end 48 of the neck 18 defining the outer opening 24 of the neck 18 when the closure device 28 is arranged on the neck 18. The closure device main body 30 has a second portion 50 extending from the intermediate portion 46 in an (according to the drawings) upward direction (e.g. in a sprout-like form). The second portion 50 includes an outer opening 52 at an outer surface 54 of the closure device main body 30.

The closure device 28 comprises a closure device printing fluid outlet opening 56, between which and the outer opening 24 of the neck 18 a closure device printing fluid outlet passage 58 extends. The closure device printing fluid outlet opening 56 can be formed by the outer opening 52 of the closure device main body 30. As illustrated, the closure device printing fluid outlet opening 56 can be comprised by a tube-like member 60 arranged in the outer opening 52 of the closure device main body 30 and extending in a (according to the drawings) downward direction into a space defined by the second portion 50 of the closure device main body 30, where the (according to the drawings) lower end of the tube-like member 60 defines the closure device printing fluid outlet opening 56. The way for dispensing printing fluid from the closure device printing fluid outlet opening 56 to the outer opening 52 of the closure device main body 30 can be referred to as closure device printing fluid outlet passageway 62.

In the closure device printing fluid outlet opening 56, there is arranged a sealing material layer 64. The sealing material layer 64 can be also referred to as septum seal.

The sealing material layer 64 is such that, in an initial condition, it forms a closed seal for the closure device printing fluid outlet opening 56 (e.g. during manufacture of the printing fluid container 2 upon being filled with printing fluid and/or subsequent handling).

For dispensing printing fluid from the printing fluid container 2, the sealing material layer 64 can be pierced or punched to create an opening in the sealing material layer 64 through which printing fluid can pass through, a condition also referred to as fluid outlet condition of the sealing material layer 64. The sealing material layer 64 can be pierced by, as described in further detail below, by means of a fluidic interconnect device of the printing fluid source 4.

The sealing material layer 64 further can assume a so-called re-sealing condition, in which the sealing material layer 64 itself closes its pierced part(s) so that the closure device printing fluid outlet opening 56 is sealed again and no printing fluid can leave the printing fluid container 2.

Figure 9A:
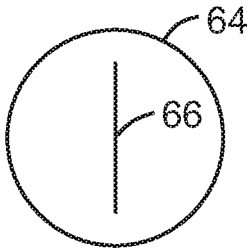
FIGS. 9*a*, 9*b* and 9*c* are illustration of cuts of a sealing material layer.
Figure 9B:
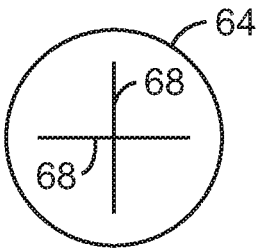
Figure 9C:
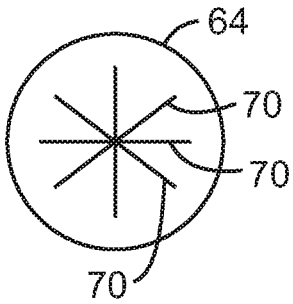

The sealing material layer 64 can comprise an elastic material, such as silicone, that inherentially regains its initial form/shape after being deformed. For being pierced, in its initial condition the sealing material layer 64 can have one or more cuts into its surface, wherein the cut(s) do not extent fully through the material layer so that the sealing material layer 64 forms a closed material layer in its initial condition. For example, the sealing material layer 64 can have a line cut 66 (see FIG. 9*a*), cross-like cuts 68 (see FIG. 9*b*), star-like cuts 70 (see FIG. 9*c*) or any number of cuts allowing to pierce the sealing material layer 64 such that it can assume its re-sealing condition afterwards. Such cut(s) can promote the piercing of the sealing material layer 64, since the sealing material layer 64 can be more easily pierced in the area(s) of the cut(s). Also, cut(s) can improve the re-sealing property of the sealing material layer 64, because cut(s) define a predefined "pierce line(s)" where the sealing material layer 64 is pierced, avoiding uncontrollable "lacerations" in the sealing material layer 64. However, cut(s) in the surface of the sealing material layer 64 are not necessary and the piercing of the sealing material layer 64 can be achieved without cut(s).

The closure device lid 32 can be arranged on the closure device main body 30 by means of a snap-fit connection, a form fit and/or friction fit connection or by means of a hinged connection 72. The closure device lid 32 comprises a lid member 74 extending from an inner surface 76 of the closure device lid 32 towards the closure device printing fluid outlet opening 56. The lid member 74 serves to close the closure device printing fluid outlet opening 56 when the closure device lid 32 is a first position, whereas the lid member 74 leaves the closure device printing fluid outlet opening 56 open when the closure device lid 32 is an a second position. In the case of a hinged connection between the closure device main body and closure device lid 32, the first position can be a position in which the closure device lid 32 is pivoted onto the closure device main body 30 and the second position can be a position in which the closure device lid 32 is pivoted away the closure device main body 30.

To prepare the printing fluid container 2 for a process to dispense printing fluid from the printing fluid container 2 to a printing fluid source 4, the closure device 28 is removed from the neck 18, the seal 26 is removed from the outer opening of the neck 18 and, then, the closure device 28 is arranged on the neck 18 again.

Figure 4:
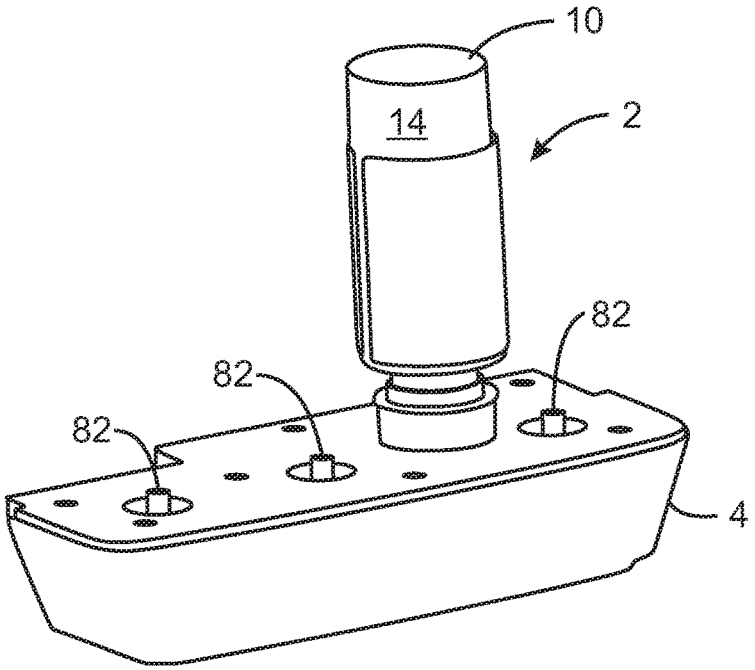
FIG. 4 is an illustration of a printing fluid container and a printing fluid source being coupled for fill/refill the printing fluid source with printing fluid.
Figure 5:
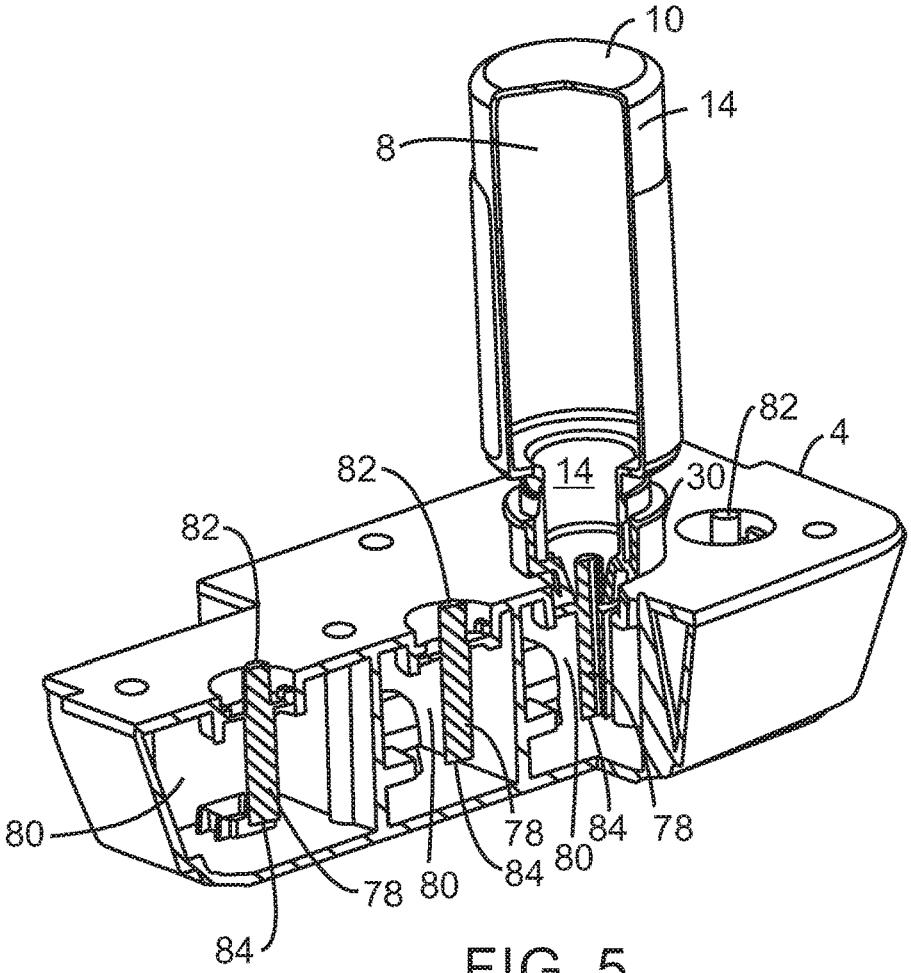
FIG. 5 is an illustration of FIG. 4 partially in cross-sectional perspective.
Figure 6A:
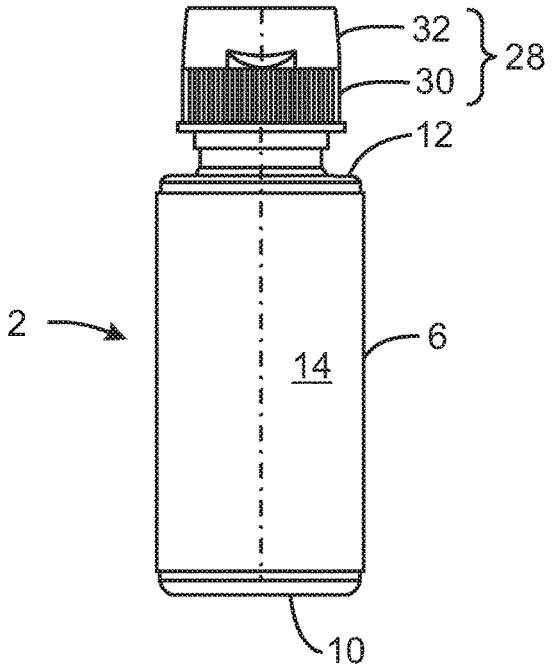
FIG. 6*a* is an illustration of a printing fluid container, FIG. 6*b* indicates the portion of the printing fluid container of FIG. 6, which portion is being shown in cross-sectional perspective in FIG. 8.
Figure 6B:
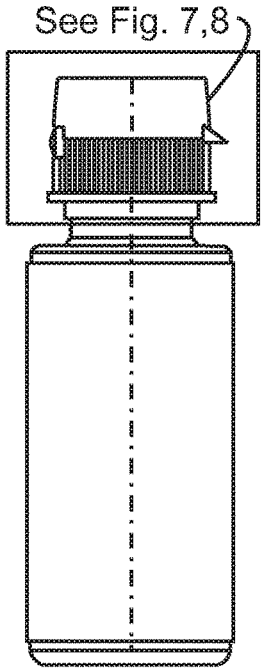

In this condition, the sealing material layer 64 is still closed and prevents printing fluid from leaving the printing fluid container 2. To dispense printing fluid, the closure device lid 32 is removed from the closure device main body 30 or pivoted away such that the lid member does not close the closure device printing fluid outlet opening 56. By turning the printing fluid container 2 up-side-down and moving it towards the printing fluid source 2 (see FIGS. 4 and 5), the closure device printing fluid outlet opening 56 can be pierced by means of a fluidic interconnect device 78 of the printing fluid source 2.

The fluidic interconnect device 78 can be a tube-like device extending from an outside of the printing fluid source 4 and also extending into an inner space 80 of the printing fluid source 4. The inner space 80 serves to store printing fluid for a printer system. In order to fill or refill the inner space 80, printing fluid from the printing fluid container 2 can be used. The fluidic interconnect device 78 provides a printing fluid inlet passage from its outer end 82 to its inner end 84 and, hence into the inner space 80.

The outer end 82 of the fluidic interconnect device 78 serves as printing fluid inlet for the printing fluid source 4 and, also, as "piercer" to pierce and, thus, open the sealing material layer 64.

When the sealing material layer 64 is pierced, printing fluid from the container space 8 can dispense through the fluidic interconnect device 78 into the inner space 80 of the printing fluid source 4 to fill/refill the same.

In order to stop/end or pause the fill/refill process, the printing fluid container 2 is removed from the fluidic interconnect device 78. Due to the sealing material layer 68 assuming its re-sealing condition, the closure device printing fluid outlet opening 56 is closed again and no printing fluid is messed or spilled. The printing fluid container 2 can be used for further fill/refill processes or to continue an interrupted one.

The sealing of the printing fluid container 2 can be supported by the lid member 74 of the closure device lid 32, namely by arranging the closure device lid 32 such that its lid member 74 closes the closure device printing fluid outlet opening 56.

Figure 10:
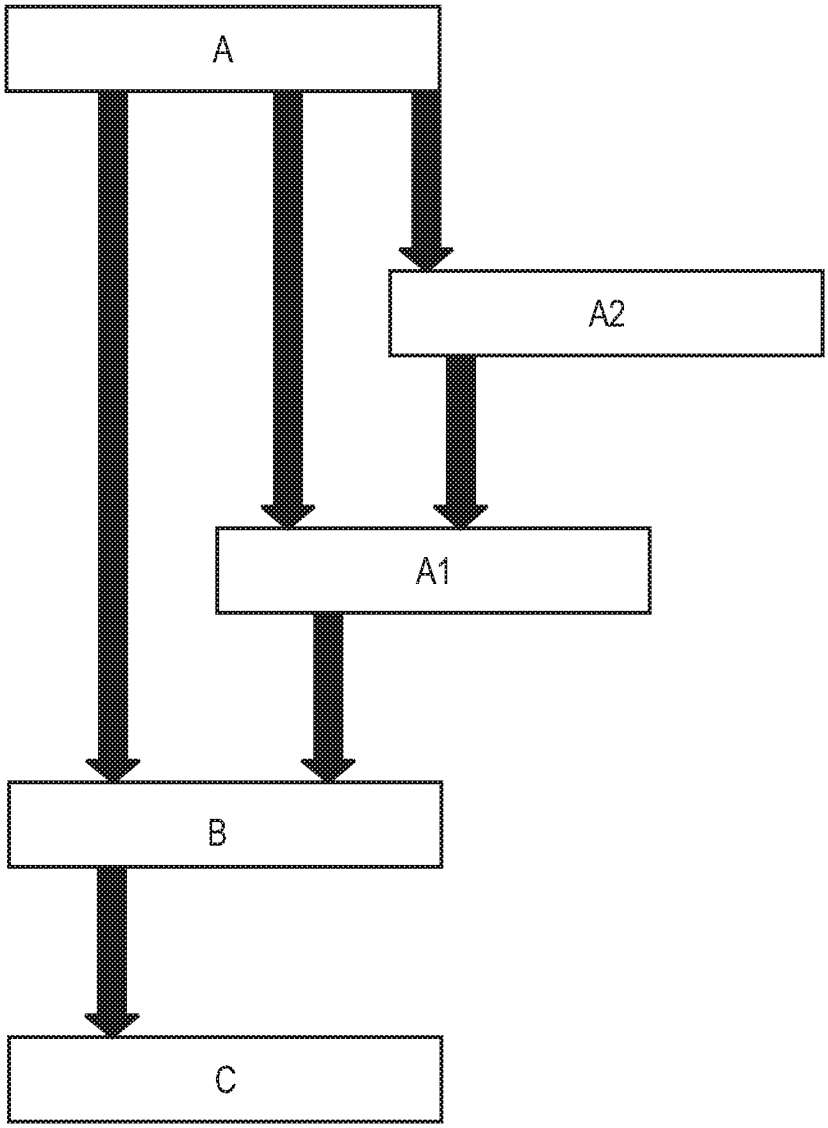
FIG. 10 is an illustration of a method of filling a printing fluid source.

FIG. 10 illustrates a method of filling a printing fluid source, which comprises a fluidic interconnect device providing a printing fluid inlet passage towards an inner space of the printing fluid source for filling printing fluid into the inner space of the printing fluid source, of a printer system with printing fluid from a printing fluid container as described above.

A of FIG. 10 indicates engaging the fluidic interconnect device and the closure device printing fluid outlet opening to pierce the sealing material layer and establishing a fluid path through the closure device printing fluid outlet opening to the printing fluid inlet passage of the fluidic interconnect device. Optionally, A of FIG. 10 can include turning the printing fluid container up-side-down from a first position to a second position.

B of FIG. 10 indicates dispensing printing fluid from the printing fluid container to the inner space of the printing fluid source.

C of FIG. 10 indicates removing the printing fluid container from the fluidic interconnect device to re-seal the closure device printing fluid outlet opening by means of the sealing material layer. Optionally, C of FIG. 10 can include turning the printing fluid container back into its first position.

A1 of FIG. 10 indicates the optional removing the neck seal before engaging the fluidic interconnect device and the closure device printing fluid outlet opening.

A2 of FIG. 10 indicates the optional removing the closure device main body from the neck before removing the neck seal if the closure device main body is removably connected to the neck.

The invention claimed is:

1. A printing fluid container for a printing fluid source for a printer system, the printing fluid container comprising:

a neck having an outer opening;

a closure device comprising:

a closure device main body connected to the neck, the closure device main body comprising a closure device printing fluid outlet opening and a closure device printing fluid outlet passage extending from the outer opening of the neck through the closure device main body to the closure device printing fluid outlet opening; and a closure device lid connected to the closure device main body, wherein the closure device lid comprises a lid member for closing the closure device printing fluid outlet opening, and the closure device lid has a first position, in which the lid member closes the closure device printing fluid outlet opening, and a second position, in which the lid member opens the closure device printing fluid outlet opening; and a sealing material layer disposed within the closure device printing fluid outlet opening of the closure device, the sealing material layer having:

an initial condition, in which the closure device printing fluid outlet opening is sealed;

a fluid outlet condition, in which the sealing material layer is pierced by engagement of a fluidic interconnect device of the printing fluid source, which fluidic interconnect device provides a printing fluid inlet passage towards an inner space of the printing fluid source, and the closure device printing fluid outlet opening establishing a fluid path through the closure device printing fluid outlet opening; and a re-sealing condition, in which the sealing material layer re-seals the closure device printing fluid outlet opening upon removal of the fluidic interconnect device.

2. The printing fluid container according to claim 1, further comprising a removable neck seal sealing the outer opening of the neck.

3. The printing fluid container according to claim 1, wherein the closure device main body is removably connected to the neck.

4. The printing fluid container according to claim 1, wherein:

the closure device main body comprises an outer opening at an outer surface of the closure device main body and a closure device printing fluid outlet passageway extending between the closure device printing fluid outlet opening and the outer opening of the closure device; and the closure device printing fluid outlet opening is located within the closure device main body.

5. The printing fluid container according to claim 1, wherein the sealing material layer comprises silicone.

6. The printing fluid container according to claim 1, wherein the sealing material layer comprises a cut into its surface, wherein the cut is selected from a group consisting of line cut, cross-like cut, and star-like cut.

* * * * *